US007494119B2

(12) United States Patent
Shibuya

(10) Patent No.: US 7,494,119 B2
(45) Date of Patent: Feb. 24, 2009

(54) IMAGE RECORDING APPARATUS

(75) Inventor: Masaaki Shibuya, Hino (JP)

(73) Assignee: Olympus Corporation, Tokyo (JP)

( * ) Notice: Subject to any disclaimer, the term of this patent is extended or adjusted under 35 U.S.C. 154(b) by 358 days.

(21) Appl. No.: 11/357,307

(22) Filed: Feb. 17, 2006

(65) Prior Publication Data

US 2006/0186593 A1 Aug. 24, 2006

(30) Foreign Application Priority Data

Feb. 23, 2005 (JP) ..... 2005-047413

(51) Int. Cl.
*B65H 5/00* (2006.01)

(52) U.S. Cl. ..... 271/10.01

(58) Field of Classification Search ..... 271/10.01
See application file for complete search history.

(56) References Cited

U.S. PATENT DOCUMENTS 4,741,526 A * 5/1988 Reed ..... 271/261
4,980,723 A * 12/1990 Buddendeck et al. ..... 399/72
5,140,166 A * 8/1992 Gerlier ..... 250/548
5,725,211 A * 3/1998 Blanchard et al. ..... 271/265.02
5,848,784 A * 12/1998 Tranquilla ..... 271/10.03
6,040,923 A * 3/2000 Takashimizu et al. ..... 358/498
RE37,007 E * 1/2001 Gerlier ..... 250/548
7,308,853 B2 * 12/2007 Satoh et al. ..... 101/118
2001/0022425 A1 * 9/2001 Toyofuku ..... 271/177
2002/0060397 A1 * 5/2002 Endo ..... 271/121
2002/0101021 A1 * 8/2002 Nonaka et al. ..... 270/58.08
2003/0038418 A1 * 2/2003 Isemura et a l. ..... 271/10.01
2003/0189285 A1 * 10/2003 Kan et al. ..... 271/226
2004/0046314 A1 * 3/2004 Satoh ..... 271/258.01
2005/0067755 A1 * 3/2005 Ueda et al. ..... 271/65
2005/0140087 A1 * 6/2005 Sano et al. ..... 271/276
2005/0158093 A1 * 7/2005 Kato et al. ..... 399/388

FOREIGN PATENT DOCUMENTS

JP 2000-203009 A 7/2000

* cited by examiner

*Primary Examiner*—Patrick H Mackey
*Assistant Examiner*—Prasad V Gokhale
(74) *Attorney, Agent, or Firm*—Frishauf, Holtz, Goodman & Chick, P.C.

(57) ABSTRACT

When an image is recorded on a recording medium conveyed by a conveyance mechanism, prescribed information is set in accordance with an interval between a first medium detection unit that is provided between a supply mechanism that supplies the recording medium and the conveyance mechanism and a second medium detection unit that is provided above the conveyance mechanism, one of the first and second medium detection units is selected on the basis of the prescribed information and detection information of each of the first and second medium detection units, and image recording is controlled on the basis of the detection information of the selected one of the first and second medium detection units and conveyance information of a conveyance information generation unit.

21 Claims, 5 Drawing Sheets

IMAGE RECORDING APPARATUS

CROSS-REFERENCE TO RELATED APPLICATIONS

This application is based upon and claims the benefit of priority from prior Japanese Patent Application No. 2005-047413, filed Feb. 23, 2005, the entire contents of which are incorporated herein by reference.

BACKGROUND OF THE INVENTION

1. Field of the Invention

The present invention relates to an image recording apparatus for recording an image on a recording medium that is conveyed by a conveying mechanism.

2. Description of the Related Art

For example, Jpn. Pat. Appln. KOKAI Publication No. 2000-203009 discloses an image recording apparatus. FIG. 9 shows a configuration of the image recording apparatus of the Publication. Referring to FIG. 9, a recording means 31 includes recording heads 31C, 31M, 31Y and 31B of cyan C, magenta M, yellow Y and black B. A conveyor belt 32 is provided under the recording means 31. The conveyor belt 32 is pulled by four rollers 32*a* and moved by each of the rollers 32*a*. A recording medium P is placed on the conveyor belt 32. As the conveyor belt 32 moves, the recording medium P is conveyed to pass the recording heads 31C, 31M, 31Y and 31B in the order designated. If the recording medium P is conveyed in this direction, the recording head 31C is located upstream in the conveyance direction, while the recording head 31B is located downstream therein. When the recording medium P is conveyed under the recording heads 31C, 31M, 31Y and 31B, an image is formed on the recording medium P through the recording heads.

An adsorption roller 33 is provided the most upstream in the conveyance direction. A detection means is provided on the upstream side of the recording means 31. The detection means detects the rotation and displacement of a spur 34. The detection means includes an encoder plate, an optical sensor, a spur holder 35, a shaft 36 and a microswitch 38. The spur 34 has a number of teeth 34*a* that are projected from the rim thereof. The encoder plate is provided on the rotating shaft and rotates together with the spur 34. The optical sensor senses the encoder plate that is rotating. The spur holder 35 holds the spur 34 rotatably at one end and has a tensile spring 37 at the other end. The other end of the spur holder 35 is urged by the tensile spring 37. The shaft 36 swingably supports the spur holder 35. The microswitch 38 detects one of the ends of the spur holder 35.

With the above detection means, the adsorption roller 33 adsorbs the recording medium P on the conveyor belt 32. The teeth 34*a* of the spur 34 are brought into contact with the recording medium P by the urge of the tensile spring 37. Thus, the spur 34 rotates in response to the conveyance of the recording medium P. The encoder plate rotates together with the spur 34. The optical sensor senses the encoder plate that is rotating, and outputs an encoder pulse.

In response to the encoder pulse, the recording heads 31C, 31M, 31Y and.31B are controlled to jet out ink or the like. The ink jet out of these recording heads is laid on the recording medium P. Accordingly, an image is formed on the recording medium P.

While the recording medium P is moving, the optical sensor outputs encoder pulses at regular intervals. It is therefore determined that a trouble occurs in the conveyance of the recording medium P if no encoder pulses are output at regular intervals. Accordingly, the microswitch 38 detects a float or a jam of the recording medium P.

BRIEF SUMMARY OF THE INVENTION

According to a first aspect of the present invention, there is provided an image recording apparatus comprising a supply mechanism which supplies a recording medium, a conveyance mechanism which conveys the recording medium supplied by the supply mechanism, an image recording unit which records an image on the recording medium conveyed by the conveyance mechanism, a first medium detection unit which detects the recording medium supplied from the supply mechanism to the conveyance mechanism, and outputs detection information, a second medium detection unit which detects the recording medium conveyed by the conveyance mechanism, and outputs detection information, a conveyance information generation unit which generates conveyance information of the recording medium conveyed by the conveyance mechanism, and a control unit which selects one of the first medium detection unit and the second medium detection unit based on prescribed information corresponding to an interval between the first medium detection unit and the second medium detection unit, and controls the image recording unit to perform an image recording operation based on the detection information output from the one of the first medium detection unit and the second medium detection unit and the conveyance information generated by the conveyance information generation unit.

According to a second aspect of the present invention, there is provided a method of recording an image, comprising causing a supply mechanism to supply a recording medium, causing a conveyance mechanism to convey the recording medium supplied by the supply mechanism, causing an image recording unit to record an image on the recording medium conveyed by the conveyance mechanism, causing a first medium detection unit to detect the recording medium supplied from the supply mechanism to the conveyance mechanism, and to output detection information, causing a second medium detection unit to detect the recording medium conveyed by the conveyance mechanism, and to output detection information, causing a conveyance information generation unit to generate conveyance information of the recording medium conveyed by the conveyance mechanism, and causing a control unit to select one of the first medium detection unit and the second medium detection unit based on prescribed information corresponding to an interval between the first medium detection unit and the second medium detection unit, and to control the image recording unit to perform an image recording operation based on the detection information output from the one of the first medium detection unit and the second medium detection unit and the conveyance information generated by the conveyance information generation unit.

DETAILED DESCRIPTION OF THE INVENTION

An image recording apparatus according to a first embodiment of the present invention will be described with reference to the accompanying drawings.

Figure 1:
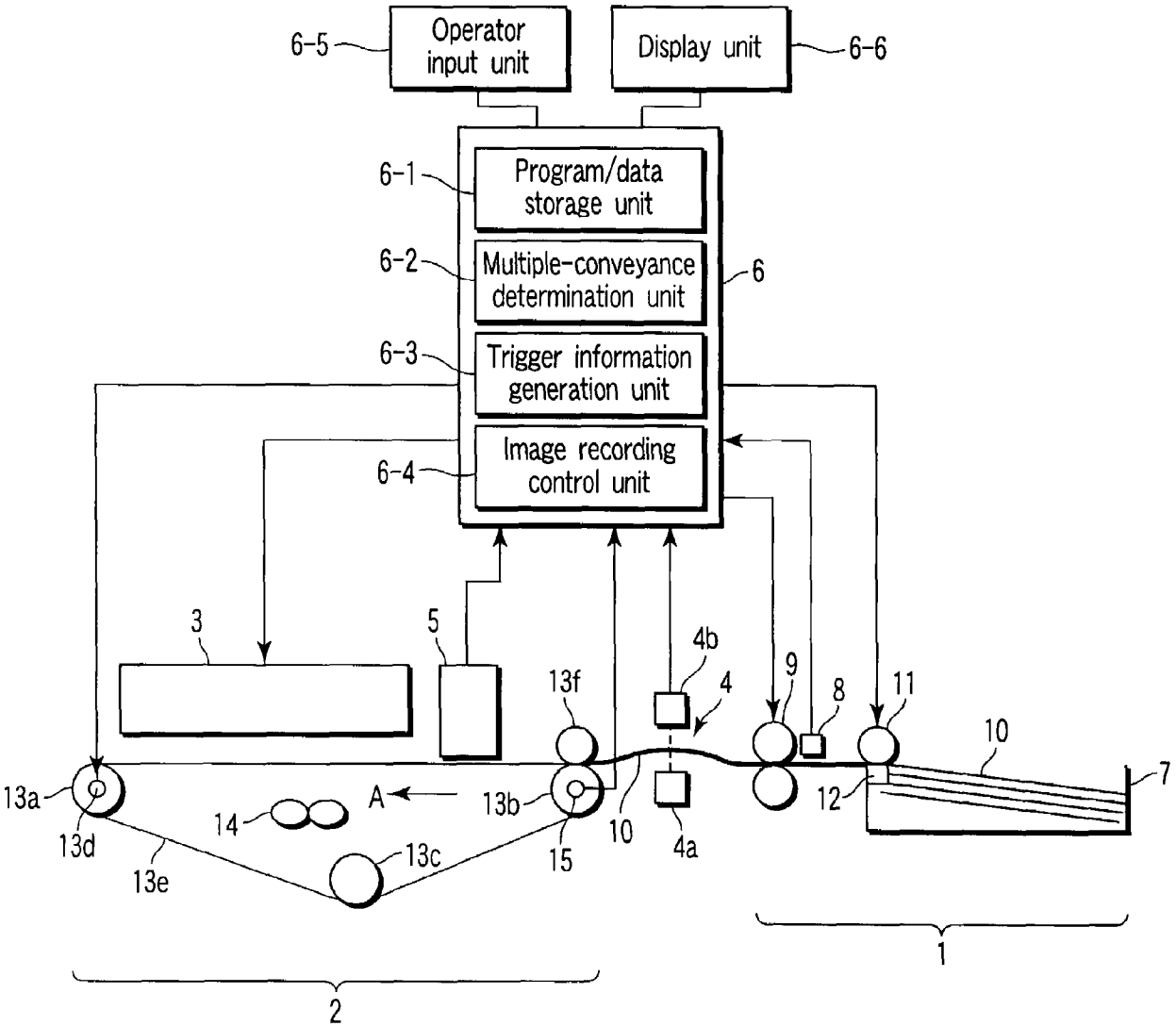
FIG. 1 is a block diagram showing an image recording apparatus according to a first embodiment of the present invention.

FIG. 1 is a block diagram of the image recording apparatus according to the first embodiment. Referring to FIG. 1, the apparatus includes a supply mechanism 1, a conveyance mechanism 2, an image recording unit 3, a first medium detection unit 4, a second medium detection unit 5 and a control unit 6.

The supply mechanism 1 has a medium storage unit 7, a medium detection unit 8 and a pair of resist rollers 9. The medium storage unit 7 stores a plurality of recording mediums 10. The medium storage unit 7 has a pickup roller 11 and a separation mechanism 12. The pickup roller 11 and separation mechanism 12 are provided on the medium supply side of the medium storage unit 7 and opposed to each other. The pickup roller 11 and separation mechanism 12 pick up the recording mediums 10 from the medium storage unit 7 one by one and supply them to the downstream medium detection unit 8. Thus, the recording medium 10 are supplied to the resist rollers 9.

The recording mediums 10 are each caught between the resist rollers 9 and sent to the conveyance mechanism 2. More specifically, the resist rollers 9 convey the recording mediums 10 detected by the medium detection unit 8 to the downstream conveyance mechanism 2. The resist rollers 9 stop after a lapse of a given period of time from when the medium detection unit 8 detects a recording medium 10. The recording medium 10 is therefore brought into the resist rollers 9 by the pickup roller 11 and sent to the resist rollers 9 for a given period of time. Consequently, even though the recording medium 10 is conveyed diagonally with respect to a conveyance direction A, its direction is corrected to a direction that is almost equal to the conveyance direction A.

The medium detection unit 8 detects whether a recording medium 10 is sent by the resist rollers 9. When the medium detection unit 8 detects the bottom end of the recording medium 10 in the conveyance direction A, the resist rollers 9 stop after a lapse of a given period of time from the detection.

The conveyance mechanism 2 conveys a recording medium 10 supplied by the supply mechanism 1 in the conveyance direction A. The conveyance mechanism 2 includes a driving roller 13*a*, driven rollers 13*b* and 13*c*, a driving motor 13*d*, a conveyor belt 13*e*, an adsorption roller 13*f* and a suction fan 14. The conveyor belt 13*e* is formed as an endless belt and formed between the driving roller 13*a* and each of the driven rollers 13*b* and 13*c*. The sucking fan 14 is provided in the conveyance mechanism 2. The sucking fan 14 is driven to adsorb air. Thus, the conveyance mechanism 2 adsorbs the recording medium 10 on the conveyor belt 13*e* by air suction and, in this state, conveys the recording medium 10 in the conveyance direction A.

The image recording unit 3 is provided above and opposite to the conveyor belt 13*e* of the conveyance mechanism 2. For example, the image recording unit 3 includes a plurality of image recording units that are arranged at regular intervals above the conveyor belt 13*e*. The image recording unit 3 jets out inks of, e.g., black K, cyan C, magenta M and yellow Y and records an image on the recording medium 10.

The first medium detection unit 4 detects a recording medium 10 that is conveyed by the resist rollers 9 and outputs information of the detection. More specifically, the first medium detection unit 4 includes a through-beam optical sensor having a phototransmitter 4*a* and a photoreceiver 4*b* opposed to each other. The phototransmitter 4*a* transmits light. The photoreceiver 4*b* receives light from the phototransmitter 4*a* or light through the recording medium 10, and outputs a signal d1 whose level corresponds to the amount of light transmitted through the recording medium 10. When a recording medium 10 enters between the phototransmitter 4*a* and photoreceiver 4*b*, the amount of light incident on the photoreceiver 4*b* decreases to an amount of light corresponding to the material of the recording medium 10, the thickness thereof or the like. When the recording medium 10 goes out from between the phototransmitter 4*a* and photoreceiver 4*b*, the amount of light incident on the photoreceiver 4*b* increases and returns to the original amount of light. Consequently, the first medium detection unit 4 outputs a signal d1 whose level corresponds to the amount of light incident on the photoreceiver 4*b*.

The first medium detection unit 4 detects the top end and the bottom end of the recording medium 10 conveyed by the conveyance mechanism 2. The top end of the recording medium 10 is the head thereof in the conveyance direction A. The bottom end of the recording medium 10 is the hoot thereof in the conveyance direction A. The first medium detection unit 4 continuously detects an amount of light transmitted through the recording medium 10 (an amount of light received by the photoreceiver 4*b*) from when the top end of the recording medium 10 is detected until the bottom end thereof is detected.

The first medium detection unit 4 can detect a multiple conveyance of two or more recording mediums 10 that overlap one another. The recording mediums 10 can vary in type according to materials, thickness, or the like. The recording mediums 10 vary in amount of transmitted light according to materials, thickness, or the like. The amount of transmitted light varies from recording medium to recording medium. Consequently, the first medium detection unit 4 can detect the multiple conveyance of the recording mediums 10 on the basis of the variations in the amount of light transmitted through the recording mediums 10. Since the first medium detection unit 4 is used to detect a multiple conveyance of recording mediums 10, it will be referred to as a multiple-conveyance sensor 4.

When the multiple-conveyance sensor 4 senses the top end of a recording medium 10 in its conveyance direction A, the conveyance mechanism 2 starts to drive the driving roller 13*a*. Thus, the conveyor belt 13*e* moves between the driving roller 13*a* and each of the driven rollers 13*b* and 13*c*. The conveyance mechanism 2 drives the suction fan 14, and the suction fan 14 performs a suction operation. The adsorption roller 13*f* guides the recording medium 10 onto the conveyor belt 13*e*. Thus, the conveyance mechanism 2 adsorbs the recording medium 10 onto the conveyor belt 13*e* and conveys it in, for example, the conveyance direction A.

Assuming here that the conveyance speed of the recording medium 10 by the resist rollers 9 is $V_1$ and that of the recording medium 10 by the conveyance belt 13*e* is $V_2$, the relationship between these speeds is $V_2 \leqq V_1$. The relationship is set in such a manner that at least the conveyance speed $V_1$ does not apply a load to the conveyor belt 13*e* when the recording medium 10 is placed on the conveyor belt 13*e* and conveyed. It is desirable that both the speeds $V_1$ and $V_2$ be the same.

The second medium detection unit 5 is provided above the conveyance mechanism 2 and upstream from the image recording unit 3 in the conveyance direction A. The unit 5 is provided, for example, between the image recording unit 3 and the adsorption roller 13*f*. The unit 5 detects at least one end of the recording medium 10, e.g., the top end thereof in the conveyance direction A. Accordingly, the second medium detection unit 5 will be referred to as a top sensor 5

The top sensor 5 has a reflecting optical sensor. More specifically, the top sensor 5 receives light reflected by the recording medium 10 and outputs a signal d2 whose level corresponds to the amount of light received. The signal d2 is a signal that increases or decreases in voltage level or amount of current.

A conveyance information generation unit 15 is coupled to the rotating shaft of the driven roller 13*b* of the conveyance mechanism 2. The unit 15 generates conveyance information of the recording medium 10 conveyed by the conveyance mechanism 2. In other words, the unit 15 generates a pulse signal ep that corresponds to the amount of conveyance of the recording medium 10 by the conveyance mechanism 2. The unit 15 has, for example, a rotary encoder. Hereinafter the conveyance information generation unit 15 will be described as a rotary encoder 15. The rotary encoder 15 outputs a pulse signal ep that corresponds to the number of rotations of the driven roller 13*b*. The count value of the pulse signal ep becomes equal to the number of encoder pulses as conveyance information.

The control unit 6 controls the image recording unit 3 to record an image in response to the signals d1 and d2 output from the multiple-conveyance sensor 4 and top sensor 5 and the pulse signal ep generated by the conveyance information generation unit 15, on the basis of information prescribed in accordance with an interval between the sensors 4 and 5. The control unit 6 is configured by a computer having a CPU, a ROM, a RAM and an I/O port. The control unit 6 includes a program/data storage unit 6-1, a multiple-conveyance determination unit 6-2, a trigger information generation unit 6-3 and an image recording control unit 6-4. An operator input unit 6-5 and a display unit 6-6 are connected to the control unit 6. The operator input unit 6-5 has a keyboard, a mouse and the like. The display unit 6-6 has a liquid crystal display and the like.

The program/data storage unit 6-1 has a ROM and stores an image recording control program, a multiple-conveyance determination program and a trigger information generation program. The image recording control program supplies a recording medium 10 from the supply mechanism 1 to the conveyance mechanism 2, conveys the recording medium 10 by the conveyance mechanism 2, and records an image on the recording medium by the image recording unit 3. The multiple-conveyance determination program determines a multiple-conveyance on the basis of the amount of light transmitted through the recording medium 10 detected by the multiple-conveyance sensor 4. The trigger information generation program generates trigger information in response to the output signal d1 of the multiple-conveyance sensor 4 and the output signal d2 of the top sensor 5 on the basis of information prescribed in accordance with an interval between the sensors 4 and 5.

Figure 2:
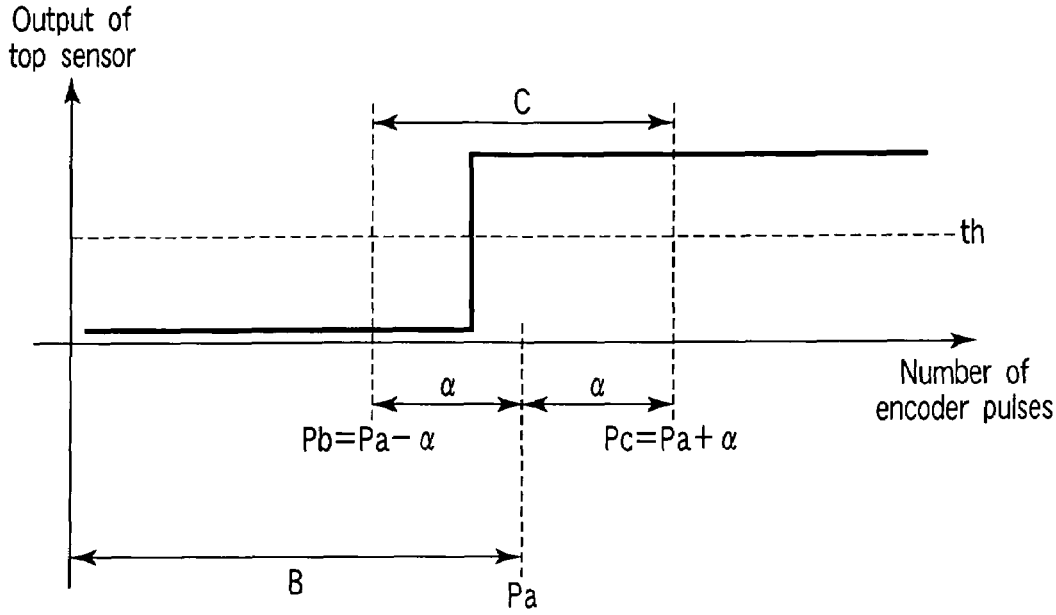
FIG. 2 is a chart of a detection signal issued when a recording medium is correctly detected by a second medium detection unit of the image recording apparatus according to the first embodiment.

The program/data storage unit 6-1 stores a first prescribed interval B, a second prescribed interval C and a threshold value th as information prescribed in accordance with an interval between the multiple-conveyance sensor 4 and the top sensor 5, as illustrated in FIG. 2.

The first prescribed interval B corresponds to the number of first encoder pulses of pulse signal ep generated by the conveyance information generation unit 15 during a period from the detection of a recording medium 10 by the sensor 4 to that of the recording medium 10 by the sensor 5, when the recording medium 10 is supplied from the supply mechanism 1 to the conveyance mechanism 2. The number of first encoder pulses is equal to the number of prescribed pulses Pa.

The second prescribed interval C is an interval between the number of pulses Pb obtained by subtracting the number of second pulses $\alpha$ from the number of prescribed pulses Pa and the number of pulses Pc obtained by adding the number of second pulses $\alpha$ to the number of prescribed pulses Pa ($Pb=Pa-\alpha$, $Pc=Pa+\alpha$). The second prescribed interval C will be referred to as a top sensor window C.

Figure 5:
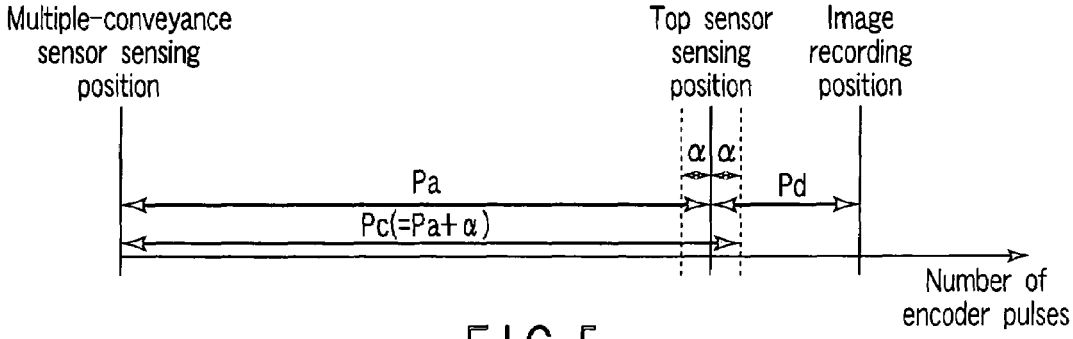
FIG. 5 is a chart of trigger information obtained when a recording medium is correctly detected by the second medium detection unit of the image recording apparatus according to the first embodiment.

The top sensor 5 is provided downstream from the multiple-conveyance sensor 4. The start position in which the image recording unit 3 starts to record an image, is located downstream from the top sensor 5. Therefore, the number of encoder pulses (Pa+Pd) of pulse signal ep, which corresponds to the start position, is larger than the number of encoder pulses Pc ($Pa+Pd>pc$),as shown in FIG. 5.

The threshold value th is used to determine a level of output signal d2 of the top sensor 5. The threshold value th is set to avoid an error in detection due to dirt on the conveyor belt 13*e* or adhesion of foreign matter thereto.

The recording mediums 10 vary in material, thickness and hardness. When a recording medium 10 is transferred from the supply mechanism 1 to the conveyance mechanism 2, it is adsorbed onto the conveyor belt 13*e* of the conveyance mechanism 2. The position of adsorption onto the conveyor belt 13*e* may slightly vary between a relatively soft recording medium 10 and a hard recording medium 10.

The number of second pulses a is set on the assumption that the position of adsorption of a recording medium 10 onto the conveyor belt 13*e* varies. Assuming that the variation is ±1.5 mm and the resolution of pulse signal ep generated by the conveyance information generation unit 15 is 300 dpi, the number of second pulses $\alpha$ needs to be 18 pulses or more.

The top sensor window C compares the level of output signal d1 of the top sensor 5 and the threshold value th, and determines whether the top sensor 5 senses a recording medium 10 normally or abnormally. If the light emitted from the top sensor 5 is almost transmitted through the recording medium 10 or scattered therein, the top sensor 5 cannot reliably sense the top end of the recording medium 10 in the conveyance direction A and, in this case, the top sensor window C determines that this sensing is abnormal. If, therefore, the level of output signal d1 is not higher than the threshold value th, the top sensor window C can determine that the sensing is abnormal. Assume in abnormal sensing that the output signal d1 of the top sensor 5 is not adopted as trigger information.

The multiple-conveyance determination unit 6-2 receives sensing signal d1 from the multiple-conveyance sensor 4, obtains the amount of light transmitted through the recording medium 10 in response to the detection signal d1, and determines a multiple transfer on the basis of the amount of transmitted light. The unit 6-2 determines a multiple conveyance of the recording medium 10 on the basis of variations in the amount of transmitted light detected by the multiple-conveyance sensor 4. In other words, the multiple-conveyance determination unit 6-2 previously stores an amount of transmitted light, which corresponds to the material or thickness of a recording medium 10, as a criterion for determination. Thus, the unit 6-2 compares the amount of transmitted light detected by the multiple-conveyance sensor 4 and the criterion stored in advance. If the amount of transmitted light is smaller than the criterion, the unit 6-2 determines the conveyance of recording mediums 10 as a multiple conveyance.

In the above case, the multiple-conveyance determination unit 6-2 receives a detection signal d1 from the multiple-conveyance sensor 4, and detects the top end and bottom end of the recording medium 10 in the conveyance direction A in response to the detection signal d1. The unit 6-2 detects the top end of the recording medium 10 due to a decrease in the level of a signal output from the sensor 4. The unit 6-2 detects the bottom end of the recording medium 10 due to an increase in the level of a signal output from the sensor 4. Thus, the unit 6-2 determines that the conveyance of recording mediums 10 in the conveyance direction A is a multiple conveyance from the detection of the top end to that of the bottom end.

The multiple-conveyance determination unit 6-2 can determine a multiple conveyance of recording mediums 10 by the following determination method. More specifically, the unit 6-2 obtains a time period required from detection of the top end of a recording medium 10 to that of the bottom end thereof in the conveyance direction A on the basis of variations in the amount of transmitted light sensed by the multiple sensor 4. The unit 6-2 determines that a plurality of recording mediums 10 are multiply-conveyed if the required time period is longer than a preset time period for determination.

The multiple-conveyance determination unit 6-2 obtains a time period required from detection of the top end of a recording medium 10 to that of the bottom end thereof in the conveyance direction A. The unit 6-2 counts pulse signals ep generated by the conveyance information generation unit 15 during the required time period. The unit 6-2 compares the count value of the pulse signals ep with a preset determination count value. If the count value is larger than the determination count value, the unit 6-2 determines that a plurality of recording mediums 10 are multiple-conveyed.

More specifically, when a recording medium 10 is supplied to the conveyance mechanism 2 by the resist rollers 9, the multiple-conveyance sensor 4 senses the top and bottom ends of the recording medium 10 in the conveyance direction A. When the sensor 4 senses the top end of the recording medium 10, its output signal d1 decreases in level. When the sensor 4 senses the bottom end thereof, its output signal d1 increases in level.

The multiple-conveyance determination unit 6-2 differentiates the output signal d1 of the multiple-conveyance sensor 4 to determine when the top end of the recording medium 10 is sensed and when the bottom end thereof is sensed. The unit 6-2 determines whether the recording medium 10 is multiple-conveyed on the basis of the level of output signal d1 of the sensor 4 during a period from the sensing of the top end of the recording medium 10 to that of the bottom end thereof. In other words, the unit 6-2 determines whether the recording medium 10 is multiple-conveyed by the above determination method. If the amount of light transmitted through the recording medium 10 is not larger than a criterion for determination, the unit 6-2 determines a multiple conveyance of two or more recording mediums 10 that are stacked.

When the multiple-conveyance determination unit 6-2 determines the multiple conveyance, it displays an alarm about the multiple conveyance on the display unit 6-6 and at the same time performs a preset operation for abnormality. This operation is, for example, to stop recording an image.

The trigger information generation unit 6-3 determines whether the level of output signal d2 of the top sensor 5 exceeds the threshold value th in the top sensor window C. This determination is based on the level of output signal d2 generated when the top sensor 5 senses the top end of a recording medium 10 in the conveyance direction A. If the level of output signal d2 exceeds the threshold value th as a result of the determination, the unit 6-3 determines that the output signal d2 is enabled and uses it as trigger information. On the other hand, if the level of output signal d2 does not exceed the threshold value th, the unit 6-3 determines that the output signal d2 is disabled and uses the output signal d1 of the multiple-conveyance sensor 4 as trigger information.

Figure 3:
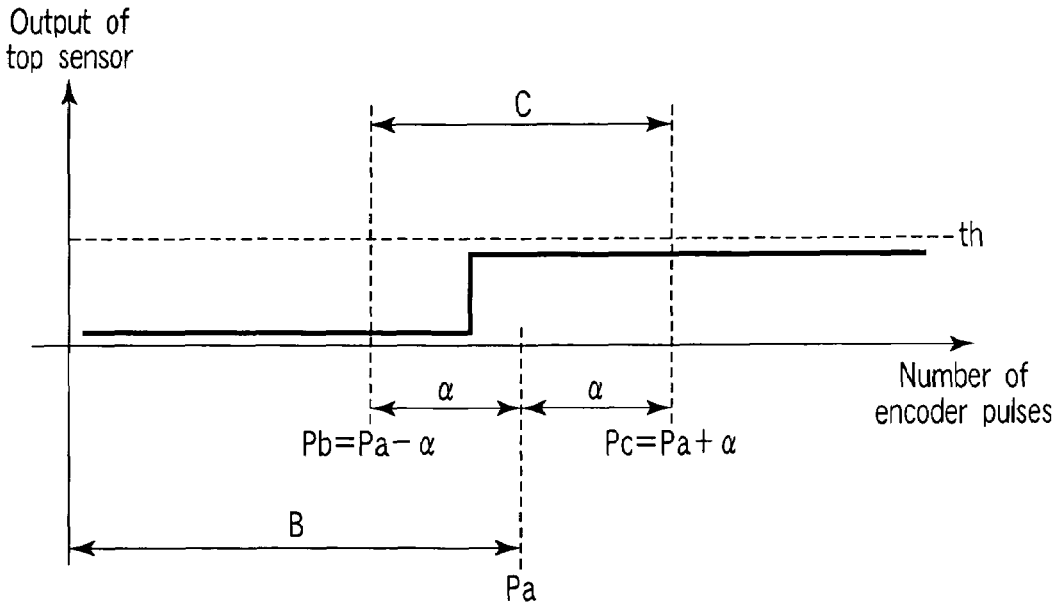
FIG. 3 is a chart of a detection signal issued when a recording medium is not correctly detected by the second medium detection unit of the image recording apparatus according to the first embodiment.
Figure 4:
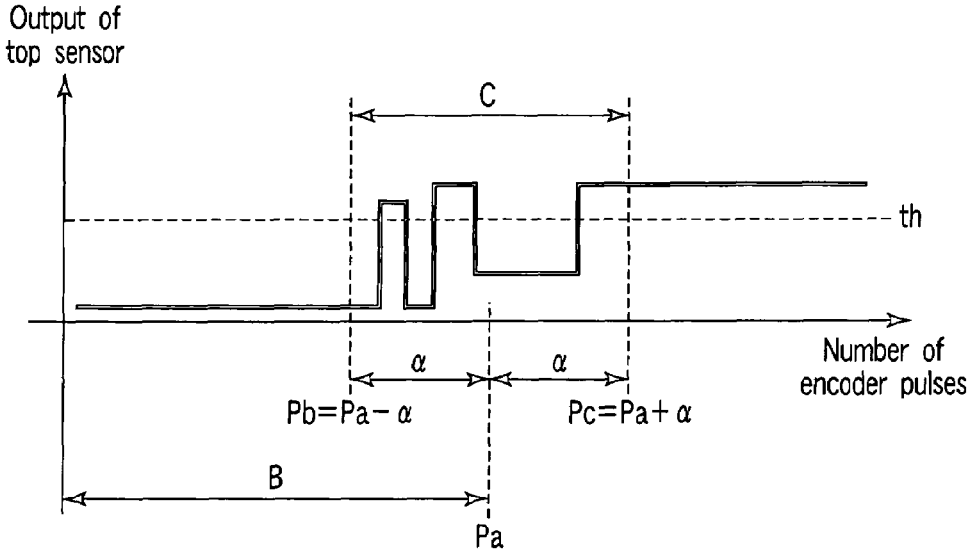
FIG. 4 is a chart of a detection signal issued when a recording medium is not correctly detected by the second medium detection unit of the image recording apparatus according to the first embodiment.

More specifically, the trigger information generation unit 6-3 sets the output signal d2 of the top sensor 5 enabled when the level of output signal d2 continuously exceeds the threshold value th as shown in FIG. 2. The unit 6-3 sets the output signal d2 disabled when the level of output signal d2 does not continuously exceed the threshold value th as shown in FIG. 3. The unit 6-3 sets the output signal d2 disabled when the level of output signal d2 exceeds the threshold value th and then falls below the threshold value th as shown in FIG. 4.

When the trigger information generation unit 6-3 sets the output signal d2 enabled, the image recording control unit 6-4 starts the image recording unit 3 to perform an image recording operation in response to the output signal d2 and the pulse signal ep generated by the rotary encoder 15.

When the trigger information generation unit 6-3 sets the output signal d2 disabled, the image recording control unit 6-4 starts the image recording unit 3 to perform an image recording operation in response to the output signal d1 of the multiple-conveyance sensor 4 and the pulse signal ep generated by the rotary encoder 15.

More specifically, when the trigger information generation unit 6-3 sets the output signal d2 enabled as shown in FIG. 2, the image recording control unit 6-4 receives the output signal d2 as trigger information and starts counting pulse signals ep generated by the rotary encoder 15 from when it receives the output signal d2 as shown in FIG. 5. The unit 6-4 starts the image recording unit 3 to perform an image recording operation from when the count value of pulse signals ep reaches the number of encoder pulses Pd corresponding to the position in which the image recording operation starts.

When the trigger information generation unit 6-3 determines that the output signal d2 is disabled as shown in FIG. 3, the image recording control unit 6-4 receives the output signal d1 of the multiple-conveyance sensor 4 as trigger information and adopts a count value of pulse signals ep generated by the rotary encoder 15 from when it receives the output signal d1. The unit 6-4 stores the number of encoder pulses Pd that are obtained in advance when the image recording apparatus is adjusted.

Consequently, the image recording control unit 6-4 sets a count value (Pa+Pd) that is obtained by adding the number of encoder pulses Pd to the number of prescribed pulses Pa from when the multiple-conveyance sensor 4 senses a recording medium 10 until when the top sensor 5 senses the recording medium 10. When the count value of pulse signals ep reaches the count value Pa+Pd, the unit 6-4 starts the image recording unit 3 to perform an image recording operation.

When the trigger information generation unit 6-3 determines that the output signal d2 of the top sensor 5 is disabled, the image recording control unit 6-4 issues to the image recording unit 3 an instruction to increase a margin in an image recording start position that is preset on the recording medium 10. The margin is input by operating the operator input unit 6-5 and stored in, for example, the program/data storage unit 6-1.

Figures 7A, 7B:
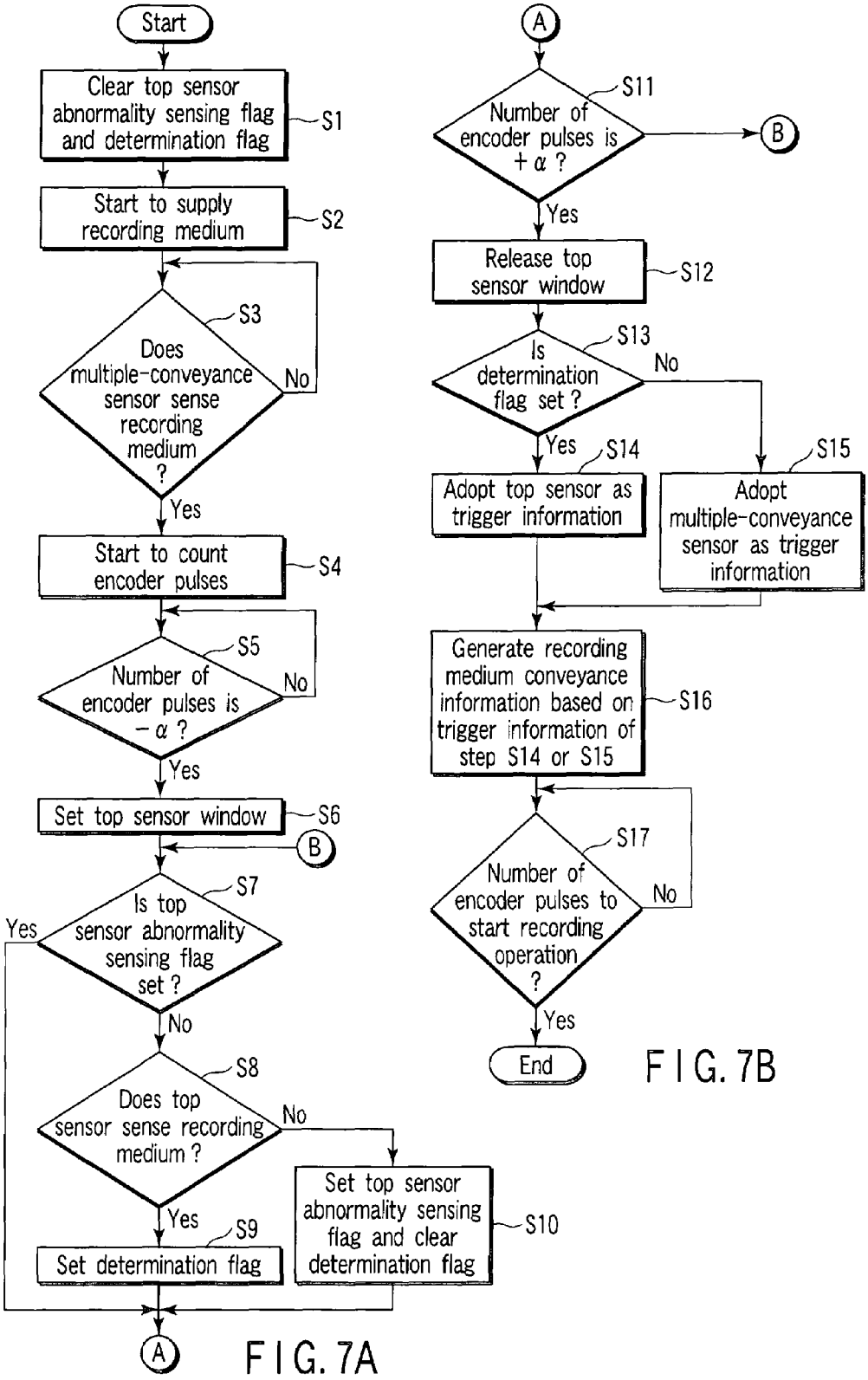
FIG. 7A is a flowchart of a trigger information setting operation and its subsequent image recording operation in the image recording apparatus according to the first embodiment.
FIG. 7B is a flowchart of a trigger information setting operation and its subsequent image recording operation in the image recording apparatus according to the first embodiment.

An operation of the image recording apparatus having the above configuration will be described with reference to a flowchart showing an image recording operation in FIGS. 7A and 7B.

In step S1, the control unit 6 clears a top sensor abnormality sensing flag and a determination flag.

In step S2, the control unit 6 issues an instruction to start to supply recording mediums 10 to the supply mechanism 1. Thus, the supply mechanism 1 picks up the recording mediums 10 one by one from the medium storage unit 7 and then supplies them to the resist rollers 9 that is located downstream. The resist rollers 9 nips the recording mediums 10 and sends them to the conveyance mechanism 2.

The multiple-conveyance sensor 4 senses the top and bottom ends of a recording medium in the conveyance direction A. When the sensor 4 senses the top end of the recording medium 10, its output signal d1 decreases in level. When the sensor 4 senses the bottom end thereof, its output signal d1 increases in level.

In step S3, the multiple-conveyance determination unit 6-2 receives the output signal d1 of the multiple-conveyance sensor 4. The unit 6-2 determines that the sensor 4 senses the top end of the recording medium 10 if its output signal d1 increases in level, and determines that the sensor 4 senses the bottom end thereof if its output signal d1 decreases in level. The unit 6-2 continuously detects an amount of light transmitted through the recording medium 10 from the output signal d1 of the sensor 4 during a period from when the sensor 4 senses the top end of the recording medium 10 until when it senses the bottom end thereof.

The multiple-conveyance determination unit 6-2 determines whether a recording medium 10 is multiple-conveyed, on the basis of the level of output signal d1 of the multiple-conveyance sensor 4, during a period from when the sensor 4 senses the top end of the recording medium 10 until when it senses the bottom end thereof. More specifically, the unit 6-2 compares the amount of transmitted light sensed by the sensor 4 and the criterion for determination stored in advance. If the amount of transmitted light is smaller than the criterion for determination as a result of the comparison, the unit 6-2 determines that a multiple conveyance occurs. Then, the unit 6-2 displays an alarm about the multiple-conveyance on the display unit 6-6 and stops recording an image.

In step S4, when the multiple-conveyance determination unit 6-2 senses the top end of the recording medium 10, the trigger information generation unit 6-3 starts to count pulse signals ep that are generated by the rotary encoder 15.

In step S5, the trigger information generation unit 6-3 determines whether the count value of pulse signals ep, or the number of encoder pulses coincides with the number of pulses Pb (=Pa−α) of the top sensor window C shown in FIG. 2. If the number of encoder pulses corresponds to the number of pulses Pb, the unit 6-3 sets the top sensor window C in step S6.

In step S7, the trigger information generation unit 6-3 determines whether a top sensor abnormality sensing flag is set or not. This flag remains cleared in step S1. Thus, the unit 6-3 determines whether the top sensor 5 senses the top end of the recording medium 10 in step S8. The top sensor 5 emits light to the recording medium 10, receives light reflected by the recording medium 10, and outputs a signal d2 whose level corresponds to the amount of light reflected by the recording medium 10. When the top sensor 5 senses the top end of the recording medium 10, it outputs a signal d2 that increases in level.

In step S8, the trigger information generation unit 6-3 determines whether the level of output signal d2 of the top sensor 5 exceeds the threshold value th in the top sensor window C shown in, for example, FIG. 2. This determination is based on the level of output signal d2 generated when the top sensor 5 senses the top end of the recording medium 10 in the conveyance direction A. If the level exceeds the threshold value th as a result of the determination, the unit 6-3 sets a determination flag in step S9.

In step S11, the trigger information generation unit 6-3 determines whether the number of encoder pulses coincides with the number of pulses Pc (=Pa+αof the top sensor window C shown in FIG. 2. If the umber of encoder pulses does not reach the number of pulses Pc, the unit 6-3 determines that the number of encoder pulses falls within the top sensor window C. If the number falls within the top sensor window C, the unit 6-3 repeats steps S7 to S11 and continues to determine whether the level of output signal d2 of the top sensor 5 exceeds the threshold value th in the top sensor window C.

If the level of output signal d2 never exceeds within the top sensor window C, the trigger information generation unit 6-3 moves to step S10 from step S8, and sets a top sensor abnormality sensing flag and clears the determination flag. For example, when the output signal d2 continuously exceeds the threshold value th as shown in FIG. 2, the unit 6-3 sets a determination flag in step S9. If the output signal d2 does not continuously exceed the threshold value th as shown in FIG. 3, the unit 6-3 sets a top sensor abnormality sensing flag in step S10 and clears the determination flag. When the level of output signal d2 exceeds the threshold value th and then falls below the threshold value th as shown in FIG. 4, the unit 6-3 sets a top sensor abnormality sensing flag and clears the determination flag.

In step S11, the trigger information generation unit 6-3 determines whether the number of encoder pulses coincides with the number of pulses Pc (=Pa+α) in the top sensor window C shown in FIG. 2. If the number of encoder pulses coincides with the number of pulses Pc, the unit 6-3 releases the top sensor window C in step S12.

In step S13, the trigger information generation unit 6-3 determines whether a determination flag is set or not. If it is set, the unit 6-3 adopts the output signal d2 of the top sensor 5 as trigger information. If not, the unit 6-3 adopts the output signal d1 of the multiple-conveyance sensor 4 as trigger information.

In steps S16 and S17, when it is determined that the output signal d2 of the top sensor 5 is enabled, the image recording control unit 6-4 starts the image recording unit 3 to perform an image recording operation in response to the output signal d2 of the top sensor 5 and the pulse signal ep generated by the rotary encoder 15. When it is determined that the output signal d2 is disabled, the unit 6-4 starts the image recording unit 3 to perform an image recording operation in response to the output signal d1 of the multiple-conveyance sensor 4 and the pulse signal ep generated by the rotary encoder 15.

When it is determined that the output signal d2 of the top sensor 5 is enabled as shown in, for example, FIG. 2, the image recording control unit 6-4 receives the output signal d2 as trigger information. In step S17, the unit 6-4 starts to count pulse signals ep generated by the rotary encoder 15 from when it receives the output signal d2. When the count value of pulse signals ep reaches the number of encoder pulses Pd that corresponds to a position in which an image recording operation starts, the unit 6-4 starts the image recording unit 3 to perform an image recording operation.

Figure 6:
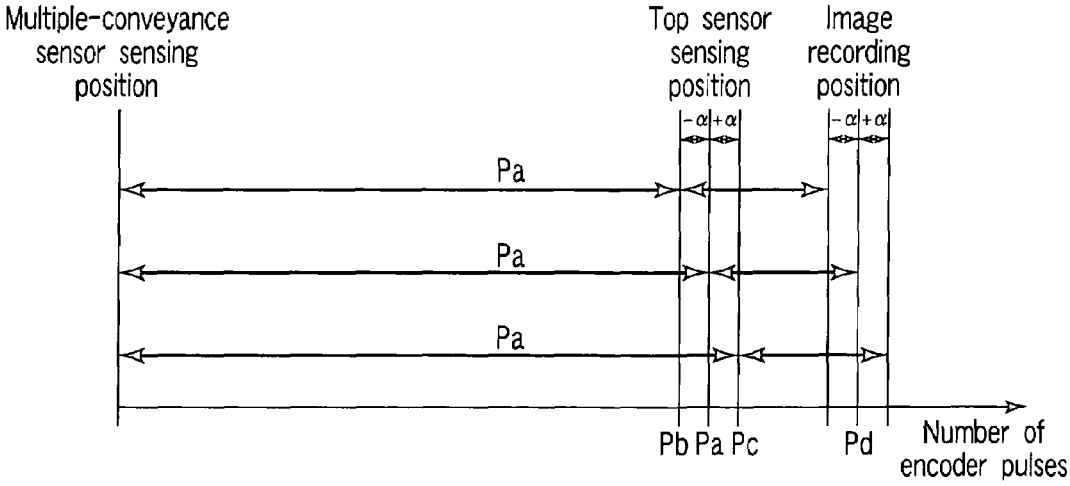
FIG. 6 is a chart of trigger information obtained when a recording medium is not correctly detected by the second medium detection unit of the image recording apparatus according to the first embodiment.

When it is determined that the output signal d2 of the top sensor 5 is disabled as shown in FIG. 3, the image recording control unit 6-4 receives the output signal d1 of the multiple-conveyance sensor 4 as trigger information, as shown in FIG. 6. In step S17, the unit 6-4 adopts a count value of pulse signals ep generated by the rotary encoder 15 from when it receives the output signal d1. When the count value reaches Pa+Pd, the unit 6-4 starts the image recording unit 3 to perform an image recording operation.

When the output signal d1 is adopted as trigger information, there is a case where the image recording position is displaced within the range of $\pm\alpha$ as shown in FIG. 6. If a frameless image is recorded with the displacement of the image recording position allowed, the image is recorded on, for example, the conveyor belt 13*e* other than the recording medium 10.

In order to avoid the above drawback, the image recording control unit 6-4 automatically selects top-end margin set data of a preset recording medium 10 and records an image on the recording medium 10. Or the unit 6-4 adds given top-end margin set data for error correction to the top-end margin set data of the preset recording medium 10 and records an image on the recording medium 10.

As described above, according to the first embodiment, the multiple-conveyance sensor 4 senses the top end of a recording medium 10 and then sets a top sensor window C on the basis of the count value of pulse signals ep that are generated by the rotary encoder 15. When the output signal d2 of the top sensor 5 continuously exceeds the threshold value th in the top sensor window C, it is used as trigger information. In response to the output signal d2 of the top sensor 5 and the pulse signal ep generated by the rotary encoder 15, the image recording unit 3 performs an image recording operation.

The position in which the image recording unit 3 starts to record an image on a recording medium 10 can always be controlled with stability. More specifically, the top sensor 5 and the image recording unit 3 are provided with a short interval therebetween above the conveyance mechanism 2. The interval between the top sensor 5 and the image recording unit 3 is narrower than the interval between the multiple-conveyance sensor 4 and the image recording unit 3. Therefore, a recording medium 10 that is conveyed from below the top sensor 5 toward a place under the image recording unit 3 is hardly displaced on the conveyor belt 13*e*. Further, there is almost no error in the count value of pulse signals ep counted during which period the recording medium 10 is conveyed from below the top sensor 5 toward a place under the image recording unit 3. Consequently, the image recording position on the recording medium 10 is always fixed.

There is a case where the color of the recording medium 10 is close to that of the conveyor belt 13*e*. There is a case where the material of the recording medium 10 has a high light transmittance. There is a case where dirt or foreign matter of the conveyor belt 13*e* is adhered to the recording medium 10. In these cases, the top sensor 5 may output the output signal d2 indicating the top or bottom end of the recording medium 10, though in actuality the top sensor 5 does not sense the top or bottom end of the recording medium 10. Thus, the multiple-conveyance determination unit 6-2 erroneously detects the top or bottom end of the recording medium 10 or is difficulty in detecting the recording medium.

In the above cases, the trigger information generation unit 6-3 does not adopt the output signal d2 of the top sensor 5 but the output signal d1 of the multiple-conveyance sensor 4 as trigger information. More specifically, when the output signal d2 of the top sensor 5 is disabled, the image recording control unit 6-4 receives the output signal d1 of the multiple-conveyance sensor 4 as trigger information. When the count value of pulse signals ep reaches a count value Pa+Pd, which is obtained by adding the number of encoder pulses Pd to the number of prescribed pulses Pa from when the multiple-conveyance sensor 4 senses the recording medium 10 until the top sensor 5 senses the recording medium 10, the image recording unit 3 starts to perform an image recording operation.

Even though the multiple-conveyance determination unit 6-2 erroneously detects the top or bottom end of the recording medium 10 or is difficulty in detecting the recording medium, the image recording position on the recording medium 10 can be almost fixed.

In the above cases, the image recording control unit 6-4 automatically selects top-end margin set data of a preset recording medium 10. Or the unit 6-4 adds given top-end margin set data for error correction to the top-end margin set data of the preset recording medium 10. Accordingly, an image is recorded on the recording medium 10.

The foregoing first embodiment can be modified as follows.

The multiple-conveyance determination unit 6-2 obtains an amount of light transmitted through a recording medium 10 in response to the output signal d1 of the multiple-conveyance sensor 4. The trigger information generation unit 6-3 receives the amount of transmitted light obtained by the unit 6-2. The unit 6-3 predicts an amount of light reflected by the recording medium 10, which is sensed by the top sensor 5 on the basis of the amount of transmitted light. Thus, the unit 6-3 can determine in advance whether the top sensor 5 can normally sense the recording medium 10.

When the unit 6-3 determines that the top sensor 5 cannot sense the recording medium 10, it does not adopt the output signal d2 of the top sensor 5 as trigger information as in the case where the output signal d2 continues to be not higher than the threshold value th.

When the unit 6-3 determines that the top sensor 5 cannot sense the recording medium 10, it can perform a preset operation for abnormality, such as an operation of stopping an image recording operation.

The operation after the determination of the trigger information generation unit 6-3 can be selected in advance by the operator input unit 6-5.

A second embodiment of the present invention will be described with reference to the accompanying drawings. The components common to those of the first embodiment shown in FIG. 1 are denoted by the same reference numerals, and their detailed descriptions of functions and advantages are omitted.

Figure 8:
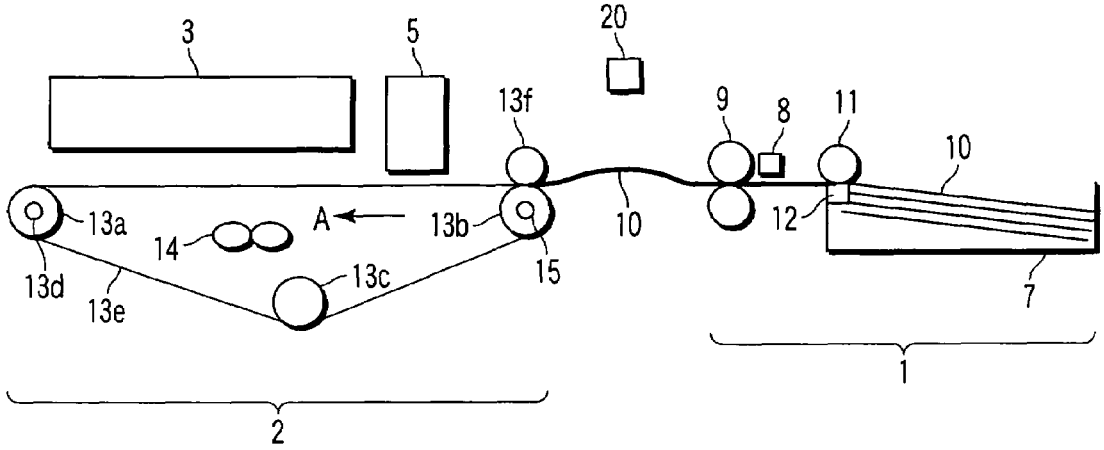
FIG. 8 is a block diagram showing an image recording apparatus according to a second embodiment of the present invention.
Figure 9:
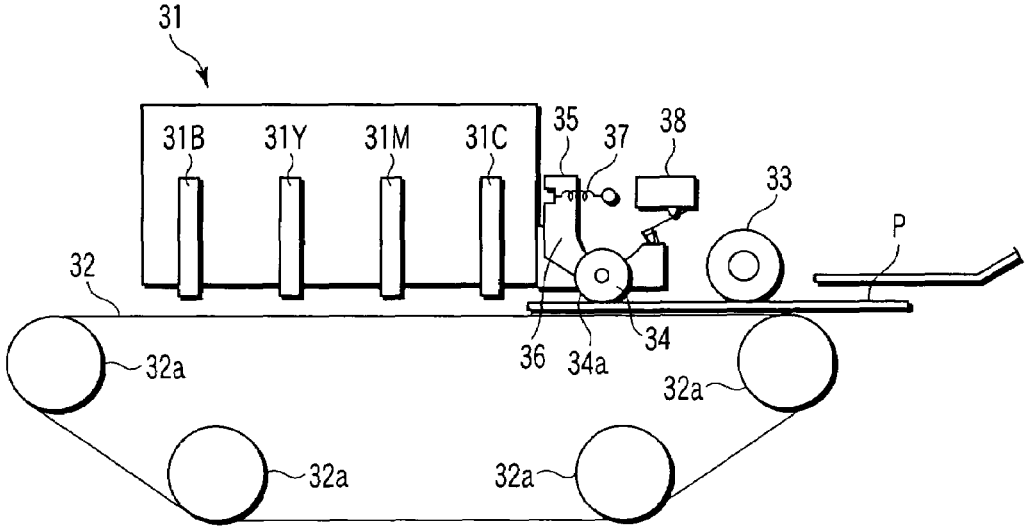
FIG. 9 (PRIOR ART)
FIG. 9 is a diagram of a prior art image recording apparatus.

FIG. 8 is a block diagram of an image recording apparatus according to the second embodiment. In this apparatus, a first medium detection unit 20 detects the top and bottom ends of a recording medium 10 conveyed by a conveyance mechanism 2. The unit 20 is a reflecting optical sensor which emits detection light to the recording medium 10 and receives light reflected by the recording medium 10.

If the recording medium 10 is of a standard size, its length in the conveyance direction A is known. A multiple-conveyance determination unit 6-2 monitors a time period required from when the first medium detection unit 20 detects the top end of the recording medium 10 until it detects the bottom end thereof, on the basis of the length of the recording medium 10 in the conveyance direction A and the conveyance speed of the recording medium 10 that is conveyed by one of a pickup roller 11 and a pair of resist rollers 9. The unit 6-2 stores in advance a determination time period from when the unit 20 detects the top end of the recording medium 10 until it detects the bottom end thereof. The unit 6-2 compares the monitored time period and the determination time period. If the former period is longer than the latter period, the unit 6-2 determines that a multiple conveyance occurs. A trigger information generation unit 6-3 performs a preset operation for abnormality, such as an operation of stopping an image recording operation.

If the recording medium 10 is of a nonstandard size, each time a recording medium 10 is conveyed, the multiple-conveyance determination unit 6-2 measures a time period from when the first medium detection unit 20 detects the top end of the recording medium 10 until it detects the bottom end thereof. The unit 6-2 stores the measured time period as a reference time period. Thus, a time period measured for one precedent to the recording medium 10, which is to be sent to the conveyance mechanism 2, is stored as a reference time period. That is, the reference time period is updated each time one recording medium 10 is conveyed.

Each time one recording medium 10 is conveyed, the multiple-conveyance determination unit 6-2 compares the reference time period with the time period from when the first medium detection unit 20 detects the top end of the recording medium 10 until it detects the bottom end thereof. If the time period is longer than the reference time period, the unit 6-2 determines that a multiple conveyance occurs. The trigger information generation unit 6-3 performs a preset operation for abnormality, such as an operation of stopping an image recording operation.

The multiple-conveyance determination unit 6-2 measures a time period from when the first medium detection unit 20 detects the top end of the recording medium 10 until it detects the bottom end thereof. The unit 6-2 counts pulse signals ep generated by a rotary encoder 15 within the measured time period. The unit 6-2 compares the counted value with a preset determination count value. If the counted value is larger than the determination count value, the unit 6-2 determines that a multiple conveyance of a plurality of recording mediums 10 occurs. The trigger information generation unit 6-3 performs a preset operation for abnormality, such as an operation of stopping an image recording operation.

According to the second embodiment described above, even though the first medium detection unit 20 of the reflecting optical sensor is used, the same advantages as those of the first embodiment can be obtained.

Since the first medium detection unit 20 is a reflecting optical sensor, it is unnecessary to perform an operation of adjusting the assembly of the image recording apparatus, such as adjustment of the optical axes of the phototransmitter 4*a* and a photoreceiver 4*b* and adjustment of the amount of received light in the through-beam optical sensor.

The top sensor 5 used in the first and second embodiments can sense the bottom end of a recording medium 10 under conveyance. In this case, the trigger information generation unit 6-3 adds a count value of pulse signals ep, which corresponds to the length of the recording medium 10 in the conveyance direction A, to the count value of pulse signals ep which corresponds to the top end of the recording medium 10. Thus, the unit 6-3 can obtain the top end of the recording medium 10.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined claims and their equivalents.

What is claimed is:

1. An image recording apparatus comprising:

a supply mechanism which supplies a recording medium;

a conveyance mechanism which conveys the recording medium supplied by the supply mechanism;

an image recording unit which records an image on the recording medium conveyed by the conveyance mechanism;

a first medium detection unit which detects the recording medium supplied from the supply mechanism to the conveyance mechanism, and which outputs detection information;

a second medium detection unit which detects the recording medium conveyed by the conveyance mechanism, and which outputs detection information;

a conveyance information generation unit which generates conveyance information of the recording medium conveyed by the conveyance mechanism; and a control unit which selects one of the first medium detection unit and the second medium detection unit based on prescribed information corresponding to an interval between the first medium detection unit and the second medium detection unit, and which controls the image recording unit to perform an image recording operation based on the conveyance information generated by the conveyance information generating unit and the detection information output from the selected one of the first medium detection unit and the second medium detection unit; and wherein the control unit sets the prescribed information in accordance with the interval between the first medium detection unit and the second medium detection unit, uses the detection information output from the selected one of the first medium detection unit and the second medium detection unit as trigger information, and controls the image recording unit to perform the image recording operation based on the trigger information and the conveyance information.

2. The image recording apparatus according to claim 1, wherein the first medium detection unit detects occurrence of multiple conveyance, in which a plurality of recording mediums are stacked and conveyed.

3. The image recording apparatus according to claim 1, wherein the first medium detection unit emits light to the recording medium and detects an amount of light transmitted through the recording medium.

4. The image recording apparatus according to claim 1, wherein the first medium detection unit detects both ends of the recording medium in a conveyance direction of the recording medium.

5. The image recording apparatus according to claim 1, wherein the first medium detection unit detects at least one end of the recording medium in a conveyance direction of the recording medium.

6. The image recording apparatus according to claim 1, wherein the second medium detection unit emits light to the recording medium and receives light reflected by the recording medium.

7. The image recording apparatus according to claim 1, wherein the conveyance information generation unit comprises a rotary encoder that generates a pulse signal.

8. The image recording apparatus according to claim 1, wherein the control unit determines whether the detection information output from the second medium detection unit is enabled based on the prescribed information, and adopts the detection information output from the second medium detection unit as the trigger information when the detection information output from the second medium detection unit is enabled.

9. The image recording apparatus according to claim 1, wherein the control unit determines whether the detection information output from the second medium detection unit is enabled based on the prescribed information, adopts the detection information output from the second medium detection unit as the trigger information when the detection information output from the second medium detection unit is enabled, and adopts the detection information output from the first medium detection unit as the trigger information when the detection information output from the second medium detection unit is disabled.

10. The image recording apparatus according to claim 1, wherein the control unit determines whether the detection information output from the second medium detection unit is enabled or disabled based on: (i) another interval that is prescribed with respect to a position at which the second medium detection unit is located and (ii) a threshold value of the detection information output from the second medium detection unit, adopts the detection information output from the second medium detection unit as the trigger information when the detection information output from the second medium detection unit is enabled, and adopts the detection information output from the first medium detection unit as the trigger information when the detection information output from the second medium detection unit is disabled.

11. The image recording apparatus according to claim 10, wherein the control unit enables the detection information output from the second medium detection unit when the detection information output from the second medium detection unit continuously exceeds the threshold value.

12. The image recording apparatus according to claim 10, wherein the control unit disables the detection information output from the second medium detection unit when the detection information output from the second medium detection unit does not continuously exceed the threshold value.

13. The image recording apparatus according to claim 10, wherein the control unit disables the detection information output from the second medium detection unit when the detection information output from the second medium detection unit exceeds the threshold value and then falls below the threshold value.

14. The image recording apparatus according to claim 10, wherein the control unit adopts the detection information output from the second medium detection unit as the trigger information and controls the image recording unit to record an image, based on the trigger information and the conveyance information, when the control unit determines that the detection information output from the second medium detection unit is enabled.

15. The image recording apparatus according to claim 10, wherein the control unit adopts the detection information output from the first medium detection unit as the trigger information and controls the image recording unit to record an image, based on the trigger information and the conveyance information, when the control unit determines that the detection information output from the second medium detection unit is disabled.

16. The image recording apparatus according to claim 10, wherein the control unit increases a margin in an image recording start position that is preset on the recording medium when the control unit determines that the detection information output from the second medium detection unit is disabled.

17. The image recording apparatus according to claim 1, wherein the first medium detection unit emits light to the recording medium and detects an amount of light transmitted through the recording medium, and the control unit detects occurrence of multiple conveyance, in which a plurality of recording mediums are stacked and conveyed, based on the amount of light detected by the first medium detection unit; and wherein the control unit performs detection for the occurrence of the multiple conveyance during a period between a time at which the first medium detection unit detects a top end of the recording medium until a time at which the first medium detection unit detects a bottom end of the recording medium in a conveyance direction of the recording medium.

18. The image recording apparatus according to claim 1, wherein the control unit measures a time period required from when the first medium detection unit detects a top end of the recording medium until the first medium detection unit detects a bottom end of the recording medium, based on the detection information output by the first medium detection unit, and the control unit detects occurrence of multiple conveyance, which a plurality of recording mediums are stacked and conveyed, based on the the measured time period.

19. The image recording apparatus according to claim 1, wherein the control unit detects occurrence of multiple conveyance, which a plurality of recording mediums are stacked and conveyed, based on conveyance information generated by the conveyance information generation unit from a time at which the first medium detection unit detects a top end of the recording medium until a time at which the first medium detection unit detects a bottom end of the recording medium in a conveyance direction of the recording medium.

20. The image recording apparatus according to claim 1, wherein:

the conveyance information generation unit comprises a rotary encoder that generates a pulse signal;

the first medium detection unit emits light to the recording medium and outputs a signal corresponding to an amount of light transmitted through the recording medium;

the second medium detection unit emits light to the recording medium and outputs a signal corresponding to an amount of light reflected by the recording medium;

the interval between the first medium detection unit and the second medium detection unit is set as a first count number of pulse signals;

a second interval, which is obtained by increasing and decreasing the first count number by a second count number, is set in the control unit;

a threshold value of the detection information output from the second medium detection unit is set in the control unit; and the control unit determines whether a level of the detection information output from the second medium detection unit exceeds the threshold value within the second interval, adopts the detection information output from the second medium detection unit as the trigger information when the level of the detection information output from the second medium detection unit exceeds the threshold value, and adopts the detection information output from the first medium detection unit as the trigger information when the level of the detection information output from the second medium detection unit does not exceed the threshold value.

21. A method for an image recording apparatus, the method comprising:

supplying a recording medium from a supply mechanism to a conveyance mechanism;

detecting, using a first medium detection unit, the recording medium as the recording medium is supplied to the conveyance mechanism, and outputting detection information from the first medium detection unit;

conveying the recording medium by the conveyance mechanism;

detecting, using a second medium detection unit, the recording medium as the recording medium is conveyed by the conveyance mechanism, and outputting detection information from the second medium detection unit;

generating conveyance information of the recording medium conveyed by the conveyance mechanism;

selecting one of the first medium detection unit and the second medium detection unit based on prescribed information corresponding to an interval between the first medium detection unit and the second medium detection unit, the prescribed information being set in accordance with the interval between the first medium detection unit and the second medium detection unit;

using the detection information output from the selected one of the first medium detection unit and the second medium detection unit as trigger information; and controlling an image recording unit to performing an image recording operation on the recording medium conveyed by the conveyance mechanism, based on the trigger information and the conveyance information.

* * * * *